US005803309A

United States Patent [19]

Yuyama et al.

[11] Patent Number: 5,803,309

[45] Date of Patent: Sep. 8, 1998

[54] TABLET FEEDER

[75] Inventors: Shoji Yuyama; Itsuo Yasunaga; Naoki Koike, all of Toyonaka, Japan

[73] Assignee: Yuyama Mfg. Co., Ltd., Osaka-fu, Japan

[21] Appl. No.: 767,063

[22] Filed: Dec. 16, 1996

[51] Int. Cl.[6] ..... G07F 11/00

[52] U.S. Cl. ..... 221/82; 221/277

[58] Field of Search ..... 221/2, 7, 9, 15, 221/69, 82, 186, 258, 277

[56] References Cited

U.S. PATENT DOCUMENTS 3,722,740 3/1973 List ..... 221/7
4,869,394 9/1989 Hurst ..... 221/7

FOREIGN PATENT DOCUMENTS 2-205523 8/1990 Japan .

*Primary Examiner*—Kenneth Noland
*Attorney, Agent, or Firm*—Wenderoth, Lind & Ponack, L.L.P.

[57] ABSTRACT

A tablet feeder has a partitioning member that allows tablets to be separated properly without causing any faults such as cracking in the pockets of the tablet array board. Tablets A accommodated in the tablet accommodating portion 2 are retained one by one into the pockets of the tablet array board 8, divided into two by the partitioning member 14, and thereafter discharged out at a discharge position. The partitioning member 14 has its partitioning portion 15 made up from a plurality of elastic bristles 17 in a comb-like shape.

4 Claims, 5 Drawing Sheets

TABLET FEEDER

BACKGROUND OF THE INVENTION

1. Field of the Invention

The present invention relates to a tablet feeder and, in particular to a tablet feeder featuring a partitioning member that partitions a pocket of the tablet array board into upper and lower two divisions.

2. Description of the Prior Art

Conventionally, the tablet feeder is so arranged that a tablet accommodating section in which a plurality of tablets are accommodated is mounted on a motor base in which a motor is housed, and that the tablet array board disposed in the tablet accommodating section is rotated by the motor so that the tablet can be discharged outside (for example, refer to Japanese Patent Laid-Open Publication No. HEI 2-205523). In more detail, referring to FIGS. 8 and 9, on the outer periphery of the tablet array board 21 accommodated in the tablet accommodating section 20, a plurality of pockets 22 are defined so as to be recessed along the direction of the rotational axis at specified intervals, so that tablets A in the tablet accommodating section 20 are fed one by one to the pockets 22. The pockets 22 are each partitioned into upper and lower two divisions by a partitioning member 23 at a specified position as the tablet array board 21 rotates. Thus, it is enabled to discharge out only the lower side one of the tablets A retained in the pocket 22 through a tablet discharge hole 24.

However, in the conventional tablet feeder, the partitioning member 23 is made of a metal thin plate, and disposed at a portion of the outer periphery of the tablet array board 21. For this reason, although there occurs no problem if the tablets A in the pockets 22 are arrayed properly as shown in FIG. 8, yet there are some cases where the tablets A, if they have caught halfway, are not partitioned well into upper and lower divisions by the partitioning member 23 as shown in FIG. 9. That is, because the partitioning member 23 will go beyond the caught tablet A, the tablet A may be sandwiched between the partitioning member 23 and the tablet array board 21 so that the tablet A may be damaged or chipped, or in some cases, that the partitioning member 23 may be deformed. This would cause a problem that the tablets A could not be discharged properly through the tablet discharge hole 24, disadvantageously.

SUMMARY OF THE INVENTION

The present invention has been developed to substantially eliminate the above-described disadvantages.

It is an object of the present invention to provide a tablet feeder equipped with a partitioning member that allows tablets to be separated properly without causing any faults such as cracking in the pockets of the tablet array board.

In order to achieve the aforementioned object, there is provided a tablet feeder comprising: a tablet accommodating section capable of accommodating a multiplicity of tablets; a tablet array board which is disposed in the tablet accommodating section and which, while being driven and rotated, retains the tablets one by one in pockets defined on an outer periphery thereof and discharges them at a discharge position; and a partitioning member whose partitioning portion located at each of the pockets of the tablet array board partitions the pocket into upper and lower two divisions, thereby restricting a number of tablets to be discharged, wherein the partitioning portion of the partitioning member comprises a plurality of elastic bristles formed into a comb shape. Preferably, the elastic bristles constituting the partitioning member are each tilted toward a downstream side of rotational direction of the tablet array board. Also, more preferably, the elastic bristles constituting the partitioning member have their cross section formed into a generally oval shape, and its minor axis is directed along the rotational direction of the tablet array board.

In the tablet feeder with the above constitution, as the tablet array board rotates, the tablets accommodated in the tablet accommodating section are retained in the pockets of the tablet array board one by one, and thereafter partitioned into upper and lower two divisions at a specified position by the partitioning portion of the partitioning member. The partitioning portion is made up from a plurality of elastic bristles formed into a comb shape, and the elastic bristles will be bent one by one when coming into contact with the tablets, gradually increasing their press-contact force so that the tablets in the pocket are divided into upper and lower two divisions smoothly. As a result, only the tablet on the lower side of the division is discharged out from the tablet accommodating section.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Figure 1:
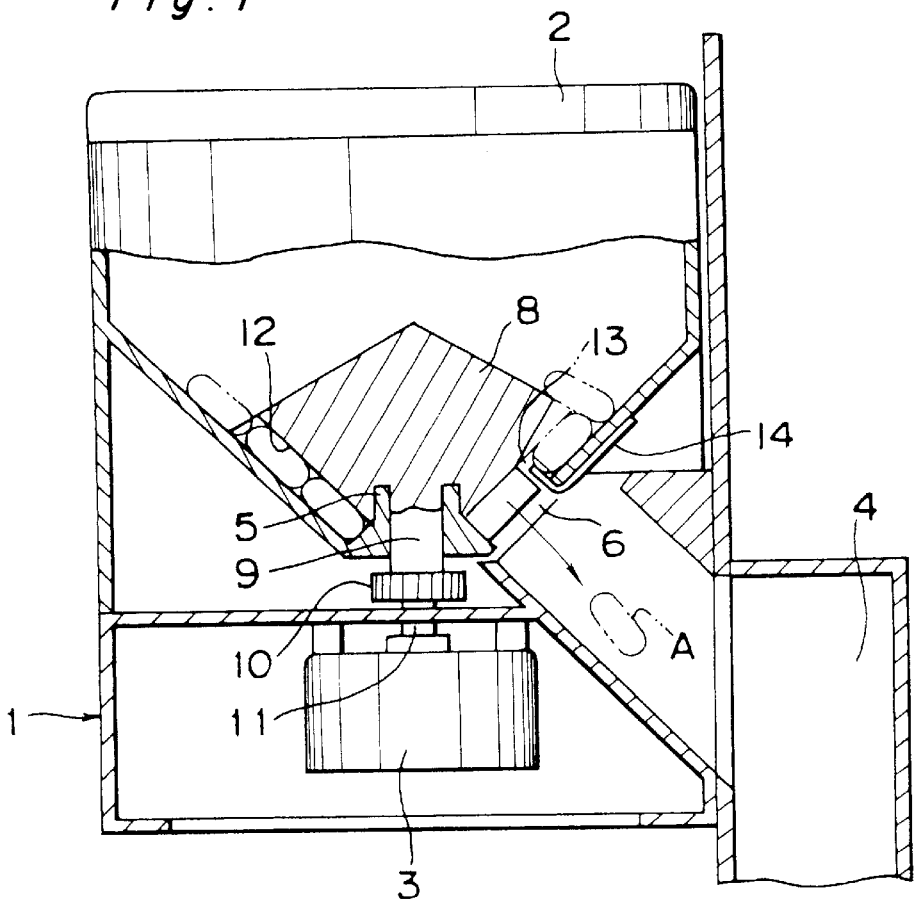
FIG. 1 is a sectional view of a tablet feeder according to the present invention.

FIG. 1 shows a tablet feeder according to the present invention. This tablet feeder generally comprises a motor base 1, and a tablet accommodating section 2 provided above the motor base 1. In the motor base 1, a motor 3 is contained and a discharge path 4 for discharging tablets A out is provided on back side. The tablet accommodating section 2 has a bottom surface formed into a generally conical shape with the cross sectional area gradually decreasing downward, and a cylindrical boss 5 is provided in the center of the bottom surface so as to protrude upward.

Figure 2:
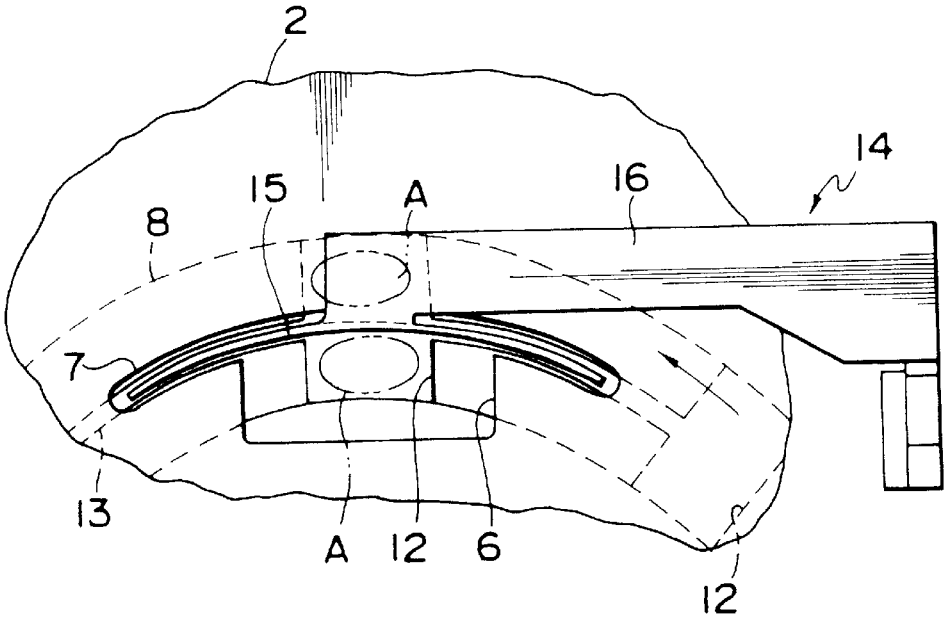
FIG. 2 is an enlarged partial bottom view of tablet accommodating section of FIG. 1.

In proximity to the outer periphery of the boss 5, a tablet discharge hole 6 is bored so as to communicate with the discharge path 4. This tablet discharge hole 6 has at least such a size that one of the tablets A accommodated in pockets 12 of the tablet array board 8 as described below are allowed to drop. Also, the accommodating section 2 has slits 7 formed by the upper inner edge of the tablet discharge hole 6 being cut out circumferentially, as shown in FIG. 2.

In the center of the bottom surface of the tablet accommodating section 2, a tablet array board 8 is disposed rotatably about the boss 5. The tablet array board 8 has a circular shape, its lower surface being formed into a generally conical shape that corresponds to the shape of the bottom surface of the tablet accommodating section 2 and its upper surface being swollen also into a conical shape. In the center of the lower surface of the tablet array board 8, a swivel 9 which fits to the boss 5 is protrudingly provided. A gear 10 attached at the lower end of the swivel 9 is engaged with an unshown gear provided to a rotating shaft 11 of the motor 3, by which rotating force of the motor 3 is transferred to the tablet array board 8. On the lower surface of the tablet array board 8, a plurality of pockets 12 are formed at equal angles to the circumferential direction, each pocket 12 having such a size that two pieces of tablets A arrayed longitudinally one by one can be accommodated therein. Between adjacent pockets 12, a thin-width recess 13 is defined circumferentially on a site corresponding to an intermediate position of the tablets A accommodated in each pocket 12.

Figure 3A:
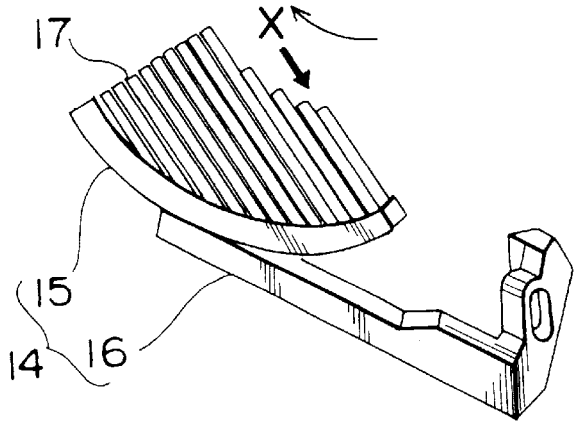
FIG. 3A is a perspective view of the partitioning member to be used in the tablet feeder of FIG. 1.
Figure 3B:
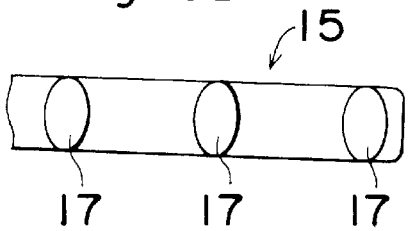
FIG. 3B is a view in the direction of the arrow X in FIG. 3A.

On the bottom outer surface of the tablet accommodating section 2, a partitioning member 14 is fixed. This partitioning member 14 is made of a synthetic resin material such as polyacetal, and comprises a partitioning portion 15 and a fixing portion 16 as shown in FIGS. 2 and 3A. The partitioning portion 15 is formed from a plurality of elastic bristles 17 tilted toward the front end (downstream in the rotational direction of the tablet array board 8) and projects in a comb-like shape. The partitioning portion 15 is projecting into the tablet accommodating section 2 via the slits 7 defined in the bottom surface of the tablet accommodating section 2 so that a pocket 12 of the tablet array board 8 is divided into upper and lower two divisions. The elastic bristles 17 each have a cross section formed into a generally oval shape as shown in FIG. 3B, and are arrayed along its minor axis. Thus, with the partitioning member 14 mounted to the tablet accommodating section 2, the elastic bristles 17 will easily be elastically deformed only along the direction of the minor axis, i.e., toward the downstream of the rotational direction of the tablet array board 8.

Figure 4:
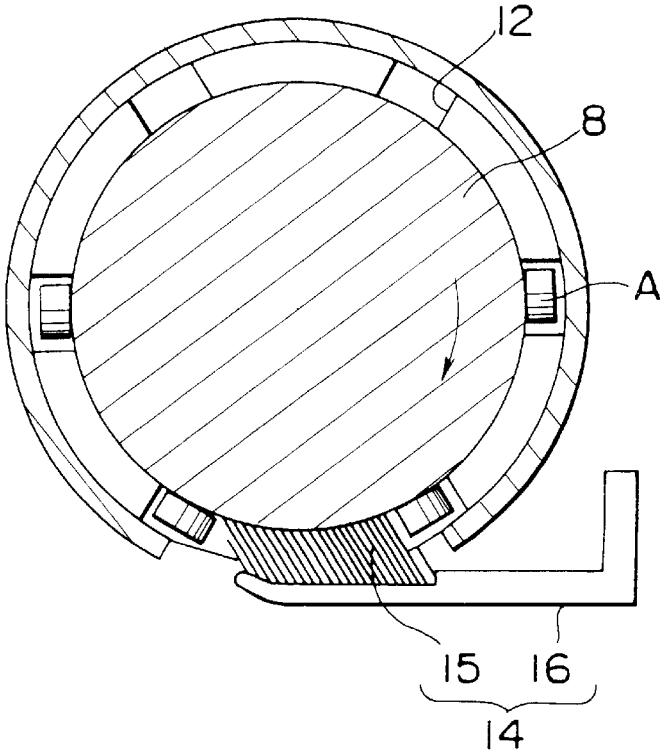
FIG. 4 is a perspective view showing a state in which the tablet located in a pocket of the tablet array board of FIG. 1 is partitioned into two divisions by the partitioning member.
Figure 9:
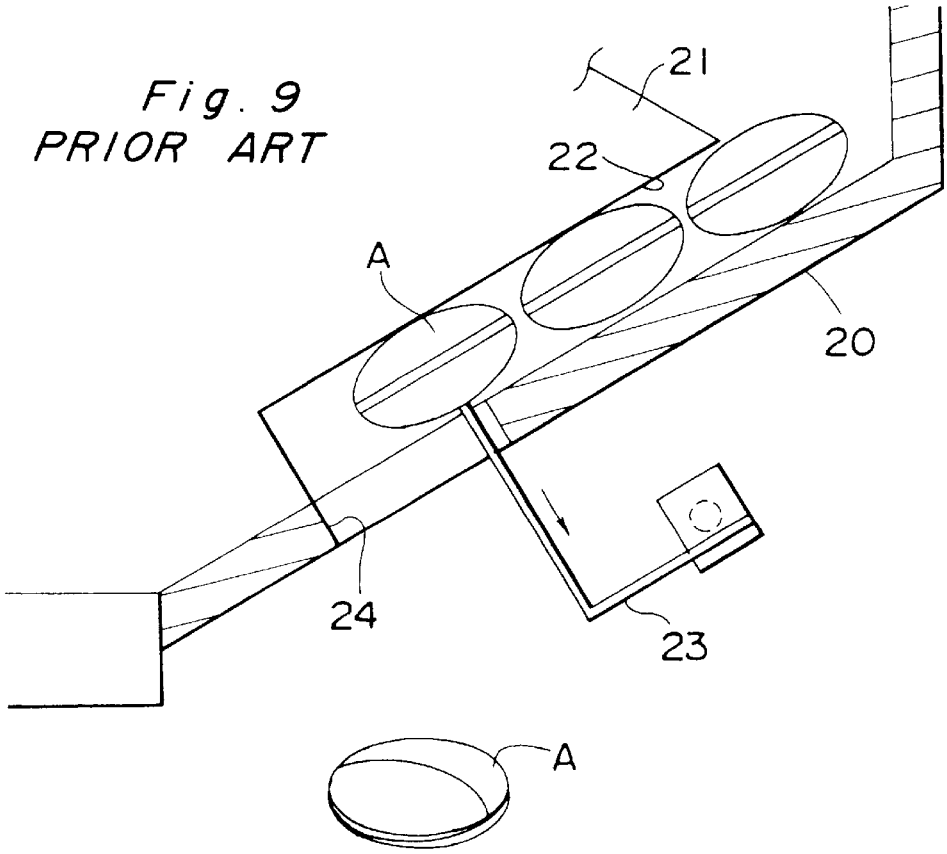
Fig. 9 PRIOR ART
FIG. 9 is a partly enlarged view showing a state in which a tablet has caught in a pocket of the tablet array board in a tablet feeder according to the prior art.

The tablet feeder with the constitution described above is used to take out the tablets A accommodated in the tablet accommodating section 2 one by one (one in this embodiment, but 2 or more possible). More specifically, the tablets A accommodated in the tablet accommodating section 2 are retained in each of the pockets 12 of the tablet array board 8 in such a state that two tablets A are arrayed and directed downward. In this state, with the tablet array board 8 rotated, the partitioning portion 15 of the partitioning member 14 enters between the two tablets A, A of each pocket 12 along with the rotation. The partitioning portion 15 is composed of a plurality of elastic bristles 17 projecting obliquely, and each elastic bristle 17 is projecting obliquely toward the downstream of the rotational direction of the tablet array board 8. Therefore, the intermediate portion of elastic bristles 17 located most upstream of the rotational direction of the tablet array board 8 first makes contact with a tablet A. The elastic bristles 17, which are all projecting in the same direction, are gradually bent under press contact with the tablet A as the tablet array board 8 rotates, thus being elastically deformed smoothly, as shown in FIG. 4. In this way, increasing numbers of elastic bristles 17 come to be elastically deformed, so that the pressing force to the tablets A increases gradually, by which the tablets A within the pockets 12 are divided into upper and lower divisions without any difficulty. Accordingly, there will never occur flaws or cracks to the tablets A. Also, even if a tablet A has caught halfway of the pocket 12 (see FIG. 9) such that the partitioning portion 15 of the partitioning member 14 passes the intermediate portion of the tablet A, the elastic bristles 17 will be elastically deformed so that flaws or cracks will never occur to the tablet A, and that the partitioning member 14 will never lead to breakage.

The above embodiment has been described on a case in which the partitioning member 14 according to the present invention is applied to a tablet feeder having pockets 12 defined in the lower surface of the conical tablet array board 8. However, it may also be applied, of course, to such tablet feeders as shown in FIGS. 5 and 7.

Figure 5:
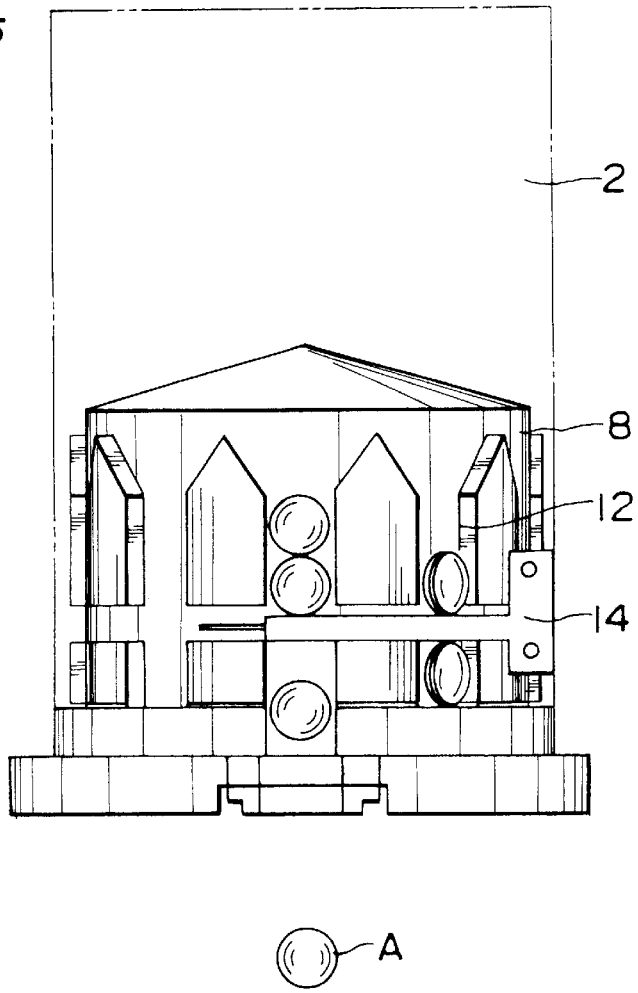
FIG. 5 is a front view showing a tablet feeder of another arrangement.
Figure 6:
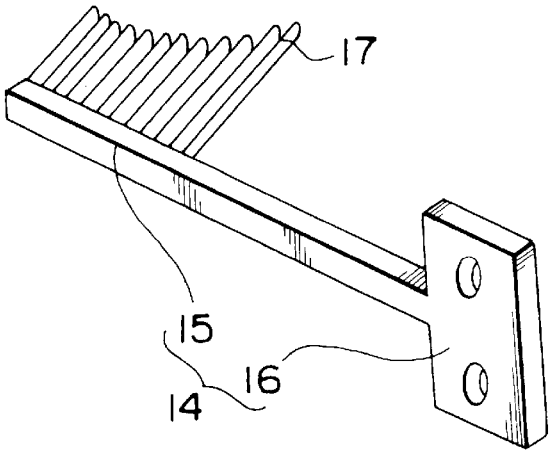
FIG. 6 is a perspective view of the partitioning member to be used in the tablet feeder of FIG. 5.

In the tablet feeder as shown in FIG. 5, a columnar tablet array board 8 is rotatably accommodated in a cylindrical tablet accommodating section 2, and a plurality of pockets 12 are defined on the cylindrical surface of the tablet array board 8. The partitioning member 14 is implemented by one having an arrangement as shown in FIG. 6. In this partitioning member 14, the elastic bristles 17 are formed at their tip into an arc shape along the outer circumferential cylindrical surface of the tablet array board 8. Whereas the tablets A are arrayed in a line along the vertical direction within the pockets 12, they can be divided into two by using the partitioning member 14 without causing flaws or cracks to the tablets A as in the foregoing embodiment, where the partitioning member 14 itself also will never lead to breakage.

Figure 7:
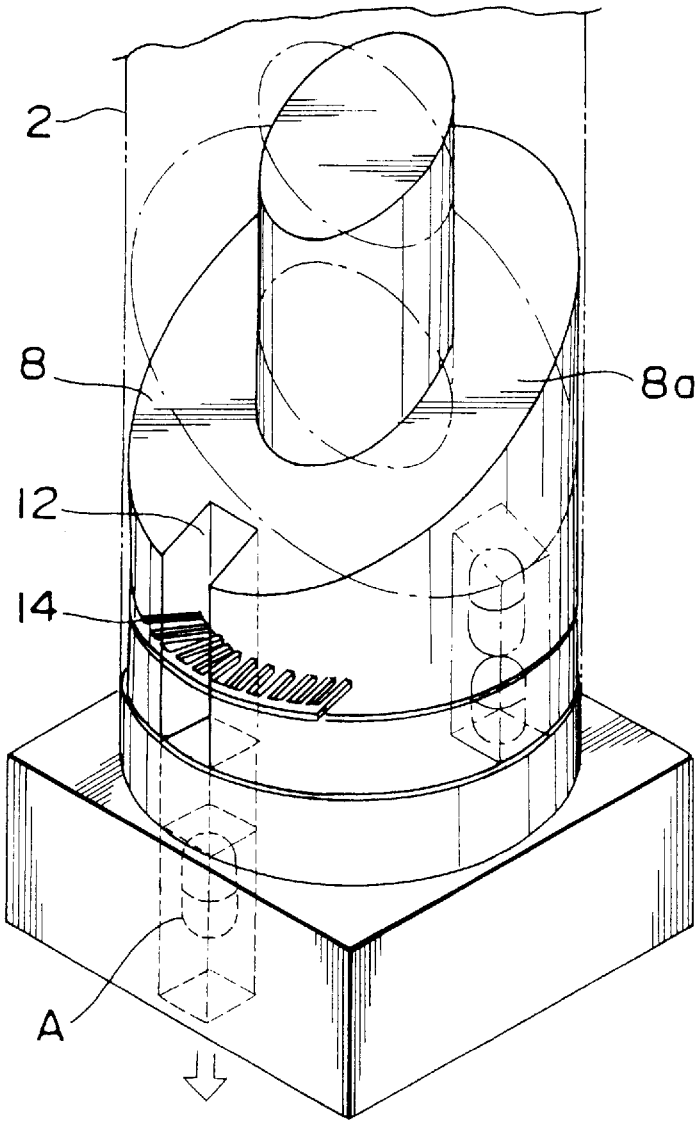
FIG. 7 is a perspective view showing a tablet feeder of yet another arrangement.
Figure 8:
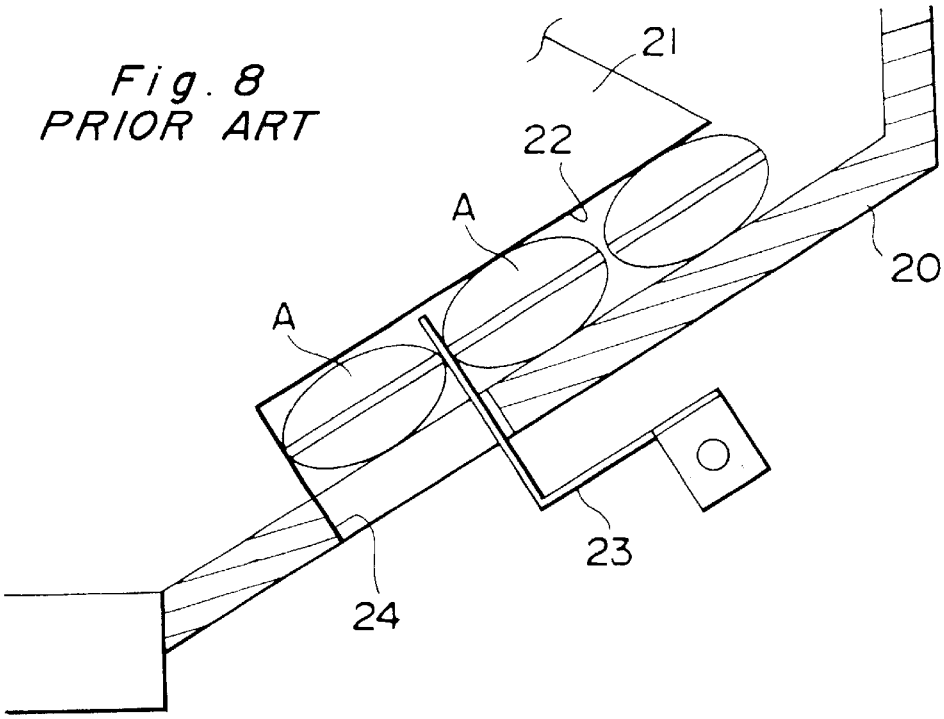
Fig. 8 PRIOR ART
FIG. 8 is a partly enlarged view showing a state in which tablets are accommodated in regular position in a pocket of the tablet array board in a tablet feeder according to the prior art.

In the tablet feeder as shown in FIG. 7, a columnar tablet array board 8 is rotatably accommodated in a cylindrical tablet accommodating section 2, and has at its top end a tilted surface 8*a*, where a pocket 12 is provided only at one place, the lowermost place of the tilted surface 8*a*. Tablets A accommodated in the tablet accommodating section 2 are introduced to the pocket 12 by the tilted surface 8*a*, and thereafter, upon reaching a discharge position, they are divided into upper and lower two divisions by the partitioning member 14. This tablet feeder also can produce the same effects as the foregoing embodiments by virtue of the partitioning member 14.

As apparent from the foregoing description, with the tablet feeder according to the present invention, since the partitioning portion is made up from a plurality of elastic bristles, the partitioning portion, after once bent under contact with the tablets, can divide the tablets into upper and lower two divisions without any difficulty. Accordingly, there is no possibility that the tablets may be damaged, chipped, or cracked, as would occur conventionally. Even if a tablet has caught halfway of the pocket, the partitioning portion itself will never lead to breakage. In particular, when the elastic bristles are tilted toward the downstream of the rotational direction of the tablet array board, or when the elastic bristles are each formed into a generally oval shape with its minor axis directed along the rotational direction of the tablet array board, the elastic bristles will make contact with the tablets and be elastically deformed smoothly in a certain direction, so that the tablets can be separated more appropriately.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being include therein.

What is claimed is:

1. A tablet feeder comprising: a tablet accommodating section capable of accommodating a multiplicity of tablets; a tablet array board which is disposed in the tablet accommodating section and which, while being driven and rotated, retains the tablets one by one in pockets defined on an outer periphery thereof and discharges them at a discharge position; and a partitioning member whose partitioning portion located at each of the pockets of the tablet array board partitions the pocket into upper and lower two divisions, thereby restricting a number of tablets to be discharged, the tablet feeder being characterized in that the partitioning portion of the partitioning member comprises a plurality of elastic bristles formed into a comb shape.

2. The tablet feeder according to claim 1, wherein the elastic bristles are each tilted toward a downstream side of rotational direction of the tablet array board.

3. The tablet feeder according to claim 1, wherein the elastic bristles have their cross section formed into a generally oval shape, and its minor axis is directed along the rotational direction of the tablet array board.

4. The tablet feeder according to claim 2, wherein the elastic bristles have their cross section formed into a generally oval shape, and its minor axis is directed along the rotational direction of the tablet array board.

* * * * *